US005530315A

United States Patent [19]

Arimoto et al.

[11] Patent Number: 5,530,315

[45] Date of Patent: Jun. 25, 1996

[54] COLOR CATHODE RAY TUBE HAVING MAGNETIC MEMBERS FOR MITIGATING EFFECTS OF AN EXTERNAL MAGNETIC FIELD ALONG AN AXIAL DIRECTION OF THE IN-LINE ELECTION GUN

[75] Inventors: Nozomu Arimoto, Takatsuki; Hirokazu Nagadori, Amagasaki, both of Japan

[73] Assignee: Matsushita Electronics Corporation, Osaka, Japan

[21] Appl. No.: 269,214

[22] Filed: Jun. 30, 1994

[30] Foreign Application Priority Data

Jul. 6, 1993 [JP] Japan ..... 5-166863

[51] Int. Cl.[6] ..... H01J 29/46

[52] U.S. Cl. ..... 313/431; 335/212

[58] Field of Search ..... 313/430, 431, 313/433, 147, 152; 335/212, 214

[56] References Cited

U.S. PATENT DOCUMENTS

| | | | |
|---|---|---|---|
| 2,431,077 | 11/1947 | Poch | 313/431 |
| 2,905,846 | 9/1959 | Klein et al. | 313/433 |
| 2,907,908 | 10/1959 | Bryan . | |
| 4,189,659 | 2/1980 | Andre et al. . | |
| 4,295,110 | 10/1981 | Uesaka | 335/212 |
| 4,625,144 | 11/1986 | Kornaker . | |
| 4,766,343 | 8/1988 | Belica . | |
| 5,157,302 | 10/1992 | Tanaka . | |
| 5,176,556 | 1/1993 | Morohashi | 445/3 |
| 5,206,559 | 4/1993 | Fujiwara et al. . | |
| 5,384,513 | 1/1995 | Ji | 313/442 |

FOREIGN PATENT DOCUMENTS

| | | |
|---|---|---|
| 0095617 | 12/1983 | European Pat. Off. . |
| 0421592 | 4/1991 | European Pat. Off. . |
| 0464576 | 1/1992 | European Pat. Off. . |
| 0580118 | 1/1994 | European Pat. Off. . |
| 58-94743 | 6/1983 | Japan . |
| 1-29299 | 6/1989 | Japan . |

*Primary Examiner*—Sandra L. O'Shea
*Assistant Examiner*—Vip Patel
*Attorney, Agent, or Firm*—Ratner & Prestia

[57] ABSTRACT

A pair of magnetic members are provided on an outer surface of a neck tube in a horizontal plane including three electron beams generated from an in-line type electron gun so as to sandwich the three electron beams. The in-line electron gun is enclosed in the thin cylindrical neck tube extending to the rear portion of a funnel glass. The magnetic members are disposed in an axis direction of the electron gun so that at least parts thereof face each other. Providing the magnetic members in this way suppresses the occurrence of the Lorentz force due to the interaction between the two outermost electron beams among the three electron beams and the external magnetic field in the axis direction of the electron gun. Therefore, misconvergence of the electron beams caused by the Lorentz force is prevented.

14 Claims, 4 Drawing Sheets

COLOR CATHODE RAY TUBE HAVING MAGNETIC MEMBERS FOR MITIGATING EFFECTS OF AN EXTERNAL MAGNETIC FIELD ALONG AN AXIAL DIRECTION OF THE IN-LINE ELECTION GUN

BACKGROUND OF THE INVENTION

1. Field of the Invention

The present invention relates to a color cathode ray tube having an in-line type electron gun.

2. Description of the Related Art

A color cathode ray tube (hereinafter, referred to as a color CRT) employing an in-line type electron gun is used in TV sets, computer monitors, and the like. In such a color CRT, in order to make three electron beams emitted from the electron gun converged on a screen, the directions of the respective outermost electron beams are changed so as to approach the center electron beam in the electron gun, as disclosed in, for example, Japanese Patent Publication No. 1-29299. The convergence of the electron beams is described with reference to FIG. 1.

FIG. 1 is a cross-sectional view of an electron gun 12 provided inside a typical color CRT and a glass panel 7 provided in front of the color CRT. The electron gun 12 includes cathodes 1*a*, 1*b*, 1*c* for emitting electrons and electrodes 3 composed of first to fourth grid electrodes G1–G4 disposed in front of the cathodes 1*a*, 1*b*, 1*c*. Intensity and focusing of electron beams 2*a*, 2*b*, 2*c* emitted from the cathodes 1*a*, 1*b*, 1*c* are controlled by applying different potentials to each of the grid electrodes G1–G4.

Hereinafter, control of the electron beams 2*a*, 2*b*, 2*c* is further described in detail.

The electron beams 2*a*, 2*b*, 2*c* corresponding to red, green and blue are emitted from the cathodes 1*a*, 1*b*, 1*c*, respectively. The electron beams 2*a*, 2*b*, 2*c* travel through the first to fourth grid electrodes G1–G4. After traveling through apertures 5 which are formed on a shadow mask 4 having a color selecting function, the electron beams 2*a*, 2*b*, 2*c* reach a phosphor screen 6 provided on the inner surface of the glass panel 7 so that phosphor materials emit light. Although not shown in FIG. 1, a deflection yoke (see FIG. 3) is disposed between the electron gun 12 and the glass panel 7. The deflection yoke deflects the electron beams 2*a*, 2*b*, 2*c* so as to scan the phosphor screen 6.

Moreover, in order to obtain an image of high quality, it is necessary to obtain sufficient convergence of the electron beams 2*a*, 2*b*, 2*c* on the phosphor screen 6. For this purpose, the through-holes of the second to fourth grid electrodes G2, G3, G4 through which the electron beams 2*a* and 2*c* travel are made eccentric among the grid electrodes G2, G3, G4 so as to form the gradient of the electric field. Thus, the directions of the respective outermost electron beams 2*a* and 2*c* on each side are changed by the gradient of the electric field among the grid electrodes G2, G3, G4 so as to gradually approach the central electron beam 2*b*.

As described above, the electron beams 2*a*, 2*b*, 2*c* are controlled inside the color CRT. However, when the color CRT operates with an external magnetic field existing, the interaction between the electron beams and the external magnetic field necessarily occurs. As a result, convergence of the electron beams cannot be properly obtained, i.e., misconvergence occurs. Even if an artificial external magnetic field does not exist, the effects of geomagnetism are inevitable.

Normally, in order to avoid the misconvergence due to the external magnetic field as described above, a magnetic shield member is provided along the inner surface or the outer surface of the color CRT between the deflection yoke and the glass panel 7 so as to enclose the electron beams 2*a*, 2*b*, 2*c*.

By providing the magnetic shield member, the effects of an external magnetic field in the perpendicular direction to the electron beams 2*a*, 2*b*, 2*c* are controlled. Strictly speaking, the effects of the external magnetic field in the direction along the straight line connecting the center of the electron gun 12 and the center of the phosphor screen 6 (hereinafter, referred to as "axis direction of the electron gun") cannot be controlled. However, the effects of the external magnetic field in the axis direction of the electron gun are not conventionally regarded as problems to be immediately solved, since the effects are generally negligibly small.

Recently, however, there have been great demands for a color CRT having high performance properties, especially to improve the quality of a resultant image. As a result, it has become necessary to pay attention to the insignificant deterioration of the quality of image due to misconvergence caused by an external magnetic field in the axis direction of the electron gun as described above. Thus, solution of the above described problem is now in urgent demand.

SUMMARY OF THE INVENTION

A color cathode ray tube according to the present invention comprises: an in-line type electron gun for generating three electron beams; and a bulb having a neck tube enclosing the in-line type electron gun, wherein the color cathode ray tube further comprises magnetic means for mitigating effects of an external magnetic field along an axis direction of the in-line type electron gun on the electron beams.

In one embodiment of the invention, the magnetic means is disposed in a horizontal plane including the three electron beams so as to sandwich the three electron beams.

Preferably, the magnetic means is respectively located between two outermost electron beams among the three electron beams and an outer surface of the neck tube. Alternatively, the magnetic means may be provided on the outer surface of the neck tube.

In another embodiment of the present invention, a color cathode ray tube further comprises: a convergence magnet; and a holder attached to the outer surface of the neck tube for holding the convergence magnet, wherein the magnetic means is provided on the inner surface of the holder.

In still another embodiment of the present invention, the magnetic means is provided on the side wall of the in-line type electron gun.

In still another embodiment of the present invention, the magnetic means is a pair of magnetic members disposed so that at least parts thereof face each other sandwiching the three electron beams in the horizontal plane including the three electron beams.

Preferably, one of the pair of the magnetic members is located between a left outermost electron beam among the three electron beams and a left outer surface of the neck tube, and the other of the pair of the magnetic members is located between a right outermost electron beam among the three electron beams and a right outer surface of the neck tube. Alternatively, one of the pair of the magnetic members is provided on the left outer surface of the neck tube, and the other of the pair of the magnetic members is provided on the right outer surface of the neck tube. Each of the pair of the magnetic members may be further divided into a plurality of portions.

In still another embodiment of the present invention, a color cathode ray tube further comprises: a convergence magnet; and a holder attached to the outer surface of the neck tube for holding the convergence magnet, wherein the magnetic members are provided on the inner surface of the holder.

In still another embodiment of the present invention, the magnetic members are provided on the side wall of the in-line type electron gun.

In still another embodiment of the present invention, the side wall of the in-line type electron gun includes the magnetic means.

In still another embodiment of the present invention, the magnetic means is formed of magnetic alloy of iron and nickel.

In still another embodiment of the present invention, the magnetic means is processed to have a plate-shape. Preferably, the thickness of the magnetic means is within a range of 0.05 mm to 0.1 mm.

Thus, the invention described herein makes possible an advantage of providing a color CRT capable of effectively preventing the misconvergence of the electron beams due to an external magnetic field in the axis direction of electron gun in an in-line type electron gun by reducing the effects of the external magnetic field on the electron beams.

This and other advantages of the present invention will become apparent to those skilled in the art upon reading and understanding the following detailed description with reference to the accompanying figures.

DESCRIPTION OF THE PREFERRED EMBODIMENTS

Figure 2:
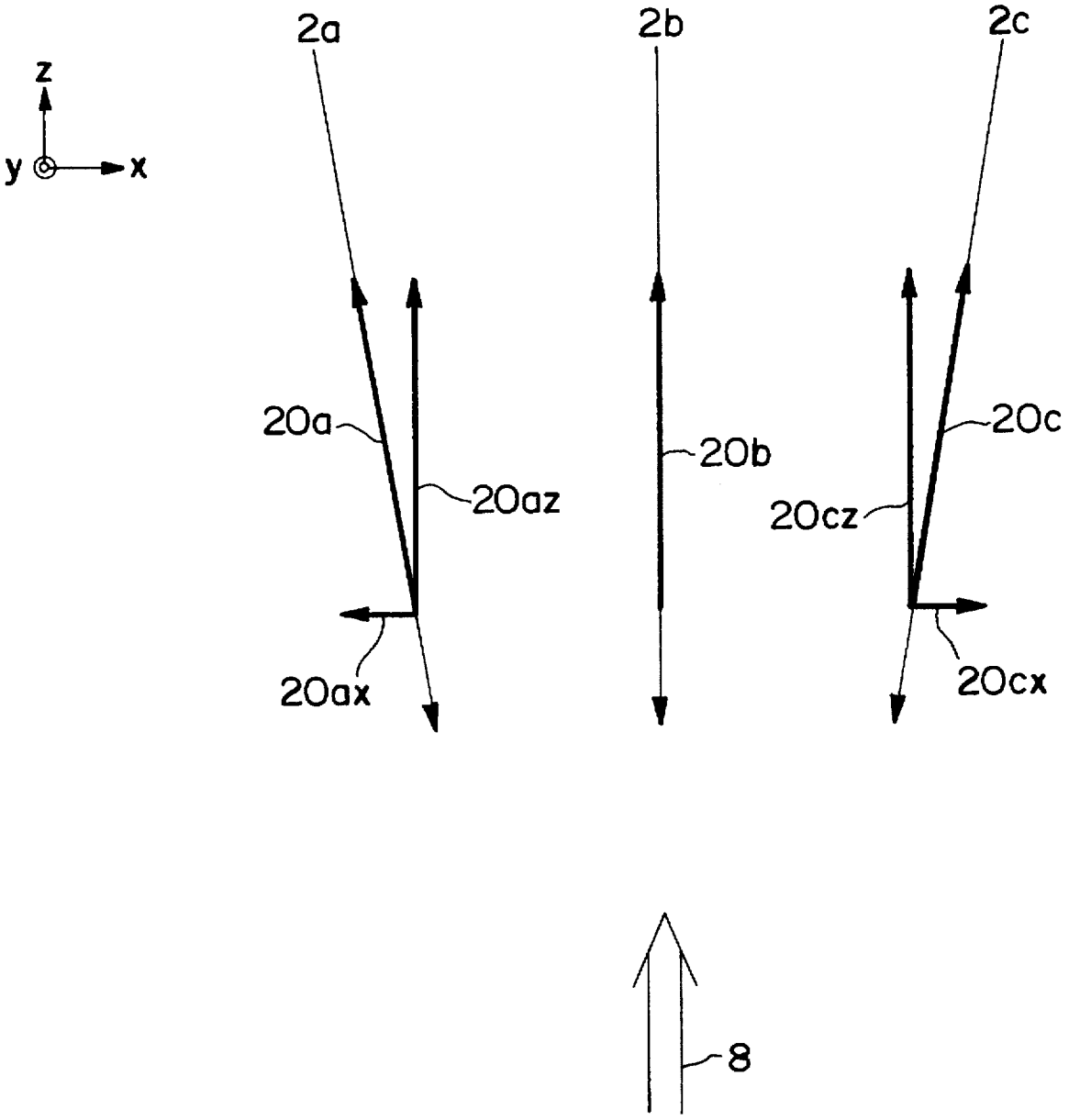
FIG. 2 schematically shows current vectors of the electron beams for illustrating the misconvergence of the electron beams which occurs due to an external magnetic field in the axis direction of the electron gun in the in-line type electron gun.

The principle in which the misconvergence of electron beams occurs due to an external magnetic field in the axis direction of the electron gun (hereinafter, referred to as the misconvergence generation principle) has not been examined in detail. Accordingly, the misconvergence generation principle examined by the inventors is described with reference to FIG. 2. FIG. 2 schematically shows the current vectors of the converged electron beams.

Current vectors 20*a*, 20*b*, 20*c* of electron beams 2*a*, 2*b*, 2*c* have an opposite direction to the electron flow. Assuming that the axis direction of an electron gun is a z-axis direction and the drawing surface of FIG. 2 is an x-z plane, the current vectors 20*a*, 20*b*, 20*c* are expressed on an orthogonal coordinate. In the outermost electron beams 2*a* and 2*c* which travel in the direction having a certain angle with respect to the z-axis direction, the current vectors 20*a* and 20*c* are decomposed into components 20*ax* and 20*az*, and components 20*cx* and 20*cz*, respectively. In the center electron beam 2*b* traveling along the z-axis direction, however, the current vector 20*b* is not decomposed (strictly speaking, the current vector 20*b* is expressed by the z-axis direction component alone; however, the description thereof is omitted in FIG. 2).

Herein, the effects of Lorentz force generated by the interaction between the external magnetic field 8 in the axis direction of the electron gun and the electron beams 2*a*, 2*b*, 2*c* will be considered. In FIG. 2, it is assumed that the direction of the external magnetic field 8 is coincident with the axis direction of the electron gun. In other words, the external magnetic field 8 is along the z-axis direction.

In the electron beams 2*a* and 2*c*, since the x-axis direction components 20*ax* and 20*cx* of the current vectors 20*a* and 20*c* are perpendicular to the direction of the external magnetic field 8, a Lorentz force is generated according to the Fleming's rule. The Lorentz force is directed downward perpendicular to the drawing surface of FIG. 2 with respect to the electron beam 20*a*. On the other hand, the Lorentz force is directed upward perpendicular to the drawing surface of FIG. 2 with respect to the electron beam 20*c*. Thus, the electron beams 2*a* and 2*c* are deviated in the directions opposite to each other.

The Lorentz force generated by the interaction between the external magnetic field 8 and the current components 20*ax* and 20*cx* of the electron beams 2*a* and 2*c* reaches a maximum when the direction of the external magnetic field 8 is coincident with the axis direction of the electron gun. Accordingly, the most remarkable effects of the Lorentz force appear in such a situation. As a result, the quality of image of the color CRT is significantly deteriorated because misconvergence occurs most remarkably.

Therefore, in order to prevent misconvergence in the color CRT, it suffices to decrease either one of the external magnetic field 8 in the axis direction of the electron gun or the x-direction components 20*ax* and 20*cx* of the current vectors 20*a* and 20*c* of the electron beams 2*a* and 2*c*, which cause the Lorentz force. Deviation of the electron beams 2*a* and 2*c* (in other words, the occurrence of the x-direction components 20*ax* and 20*cx* of the current vectors 20*a* and 20*c*) is theoretically inevitable in the color CRT. Thus, in order to prevent misconvergence due to the above, it is necessary to decrease the external magnetic field 8 in the axis direction of the electron gun as much as possible.

Hereinafter, the present invention, which is fabricated based on the above-mentioned consideration of the misconvergence generation principle, will be described by way of illustrative examples, with reference to the accompanying drawings.

EXAMPLE 1

Figure 1:
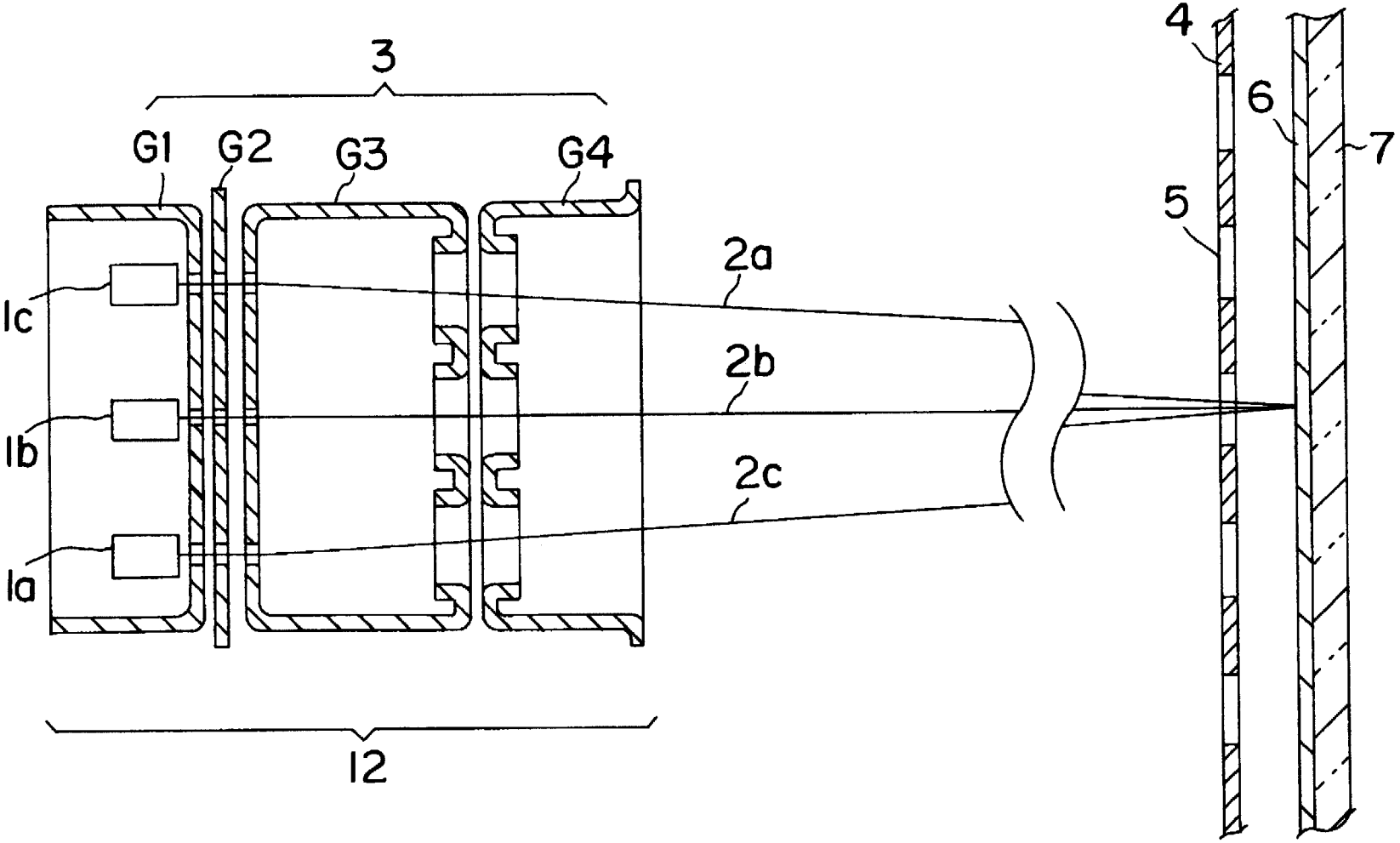
FIG. 1 PRIOR ART
FIG. 1 schematically shows the convergence of electron beams in an in-line type electron gun.

A color CRT 30 in Example 1 according to the present invention will be described with reference to FIG. 3. In the color CRT 30, components which correspond to those in FIG. 1 are indicated by the same reference numerals.

The color CRT 30 of Example 1 has a bulb 19 which includes a glass panel 7 and a funnel glass 9, having a funnel shape, fused and attached to the glass panel 7. The long thin cylinder-shaped portion extending backword from the funnel glass 9 constitutes a neck tube 11. Inside the neck tube 11, an in-line type electron gun 12 is enclosed. The in-line type electron gun 12 emits three electron beams 2a, 2b, 2c toward a phosphor screen (not shown in FIG. 3, but see FIG. 1) formed on the inner surface of the glass panel 7. The emitted electron beams 2a, 2b, 2c reach the phosphor screen so that the phosphor materials emit light. The electron gun 12 is disposed so that the plane including the traces of the electron beams 2a, 2b, 2c further includes the horizontal direction of the phosphor screen.

Outside the expanding portion of the funnel glass 9 extending from the neck tube 11, a deflection yoke 10 is provided so as to deflect the electron beams 2a, 2b, 2c emitted from the electron gun 12 up and down, and right and left.

Figure 3:
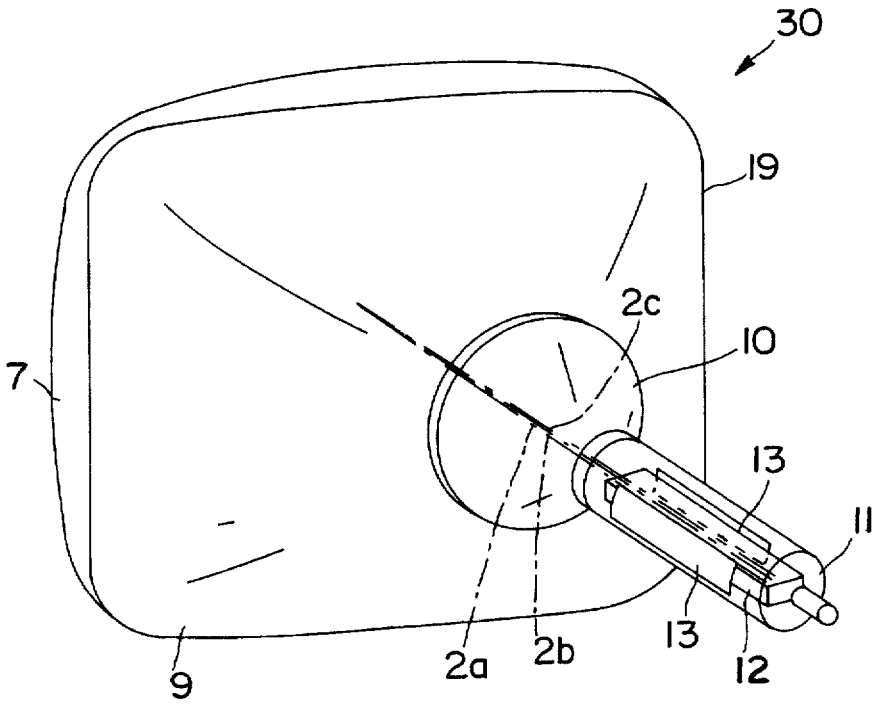
FIG. 3 is a perspective view of a color CRT in Example 1 according to the present invention.

Moreover, inside the bulb 19, a magnetic shield member, not shown in FIG. 3, is provided. The magnetic shield member is disposed so as to enclose the electron beams 2a, 2b, 2c emitted from the electron gun 12 inside the bulb 19, thereby blocking the components of the external magnetic field perpendicular to the electron beams 2a, 2b, 2c.

The configuration of the color CRT 30 of Example 1 as described above is generally similar to those of the conventional color CRTs. However, the color CRT 30 of Example 1 further includes a pair of magnetic members 13 attached to the outer surface of the neck tube 11. The magnetic members 13 mitigate the effects of an external magnetic field in the axis direction of the electron gun 12 on the electron beams 2a, 2b, 2c. As a result, misconvergence due to the external magnetic field in the axis direction of the electron gun can be significantly reduced. The magnetic members 13 will be further described in detail as follows.

The magnetic members 13 used in Example 1 include a pair of parts (left and right parts). Each of the parts of the magnetic members 13 is disposed in the horizontal plane including the electron beams 2a, 2b, 2c so that at least parts thereof face each other interposing the electron beams 2a, 2b, 2c therebetween. The respective two parts of the magnetic members 13 extend along the axis direction of the electron gun.

The magnetic members 13 may be formed of magnetic material having a specific magnetic permeability greater than 1. For example, the magnetic members 13 may be formed by processing a magnetic alloy of iron and nickel, listed in JIS (Japanese Industrial Standard)-C-2531, into a plate-shape.

In the color CRT 30 having the above-mentioned magnetic members 13, the external magnetic field in the axis direction of the electron gun tends to pass through the inside of the magnetic members 13, because the magnetic members 13 have a higher magnetic permeability.

With respect to FIG. 2 shown hereinbefore, the magnetic members 13 can be drawn as disposed so as to sandwich the electron beams 2a, 2b, 2c from the left and right sides. When there are no magnetic members 13, the external magnetic field 8 has only a component in the axis direction of the electron gun (the z-direction component) in FIG. 2, since the external magnetic field 8 is assumed to be along the z-axis direction in the figure. However, providing the magnetic members 13, as in the present example, causes the external magnetic field 8 to be curved toward the magnetic members 13 on the right and left sides. Thus, the z-direction component thereof becomes smaller, and the x-direction component becomes larger. Since the x-direction component of the external magnetic field 8 is not perpendicular to the current components 20ax and 20cx of the electron beams 2a and 2c, the Lorentz force causing misconvergence of the electron beams is not generated.

In addition, the interaction between the x-direction component of the external magnetic field and the current components 20ax and 20cx of the electron beams 2a and 2c produces the Lorentz force. This particular Lorentz force functions in the direction to adjust the aforementioned misconvergence.

As a result, the misconvergence of the electron beams can be prevented.

The method for attaching the magnetic members 13 is not limited to a specific method. For example, the magnetic members 13 can be attached to the outer surface of the neck tube 11 by using a fixing member, such as a supporting ring or a tape. Alternatively, the magnetic members 13 can be attached using an adhesive. Alternatively, it is possible to extend the magnetic members 13 from the deflection yoke 10 or a socket (not shown) attached to the back end of the neck tube 11.

In the above description, the magnetic members 13 are disposed on the outer surface of the neck tube 11; however, the magnetic members 13 may be disposed on the inner surface of the neck tube 11. Alternatively, the same advantage can be obtained by disposing each of the magnetic members 13 between the electron beams 2a and 2c and the inner surface of the neck tube 11, respectively. In such a case, the magnetic members 13 can be supported by and fixed to the constituent components of the electron gun 12 using any supporting members.

In the case where the magnetic members 13 are supported by and fixed to the constituent components of the electron gun 12, spacing between the left and right parts of the magnetic members 13 may not necessarily be constant. Moreover, each of the left and right parts does not have to be parallel to the axis direction of the electron gun. For example, the magnetic members 13 may be disposed so that the spacing between the right and left parts thereof becomes gradually broader as moving from the front end nearer to the phosphor screen 6 to the back end. Each of the left and right parts of the magnetic members 13 may be further divided into front and rear portions, and the divided magnetic members 13 may be disposed so that the spacing between the rear portions is broader than that between the front portions. Alternatively, each of the left and right parts of the magnetic members 13 can be divided into three or more portions. However, in any of the cases mentioned above, the spacings between the left and right parts of the magnetic members 13 is required to become gradually narrow as being closer to the phosphor screen 6 (the front side) in order to effectively induce the concentration of an external magnetic field to the magnetic members 13.

Furthermore, the magnetic members 13 are described as the plate-shaped members formed of the magnetic materials in the above. However, other magnetic members formed by other processing methods and having other shapes can also be used. For example, a net-like member resulting from the processing of the magnetic material can be used. Alternatively, a tape to which the magnetic material is added may be attached to the surface of the neck tube 11. Alternatively, a film made of a coating or a binder to which the magnetic material is added may be formed on the surface of the neck tube 11 by methods such as coating or sputtering.

As described above, the magnetic members 13 preferably exist between the outermost electron beams 2a and 2c and the outer surface of the neck tube 11 in the horizontal plane including the electron beams 2a, 2b, 2c. If the magnetic members 13 exist further away from the outer surface of the neck tube 11 to the outside, the advantage of the present invention of preventing misconvergence is not sufficiently obtained, since the outer magnetic field is not sufficiently concentrated to the magnetic members 13 so as to pass therethrough.

Furthermore, in the above description, the magnetic members 13 have the two separated right and left parts. However, these two parts of the magnetic members 13 may be physically connected to each other by a portion such as a frame. On the other hand, however, the inventors have found that misconvergence of the electron beams cannot be sufficiently prevented with the magnetic member having a cylindrical shape surrounding the entire periphery of the neck tube 11. Consequently, it is preferable to avoid a magnetic member having such a cylindrical shape.

EXAMPLE 2

Next, Example 2 of the present invention will be described with reference to FIG. 4.

Figure 4:
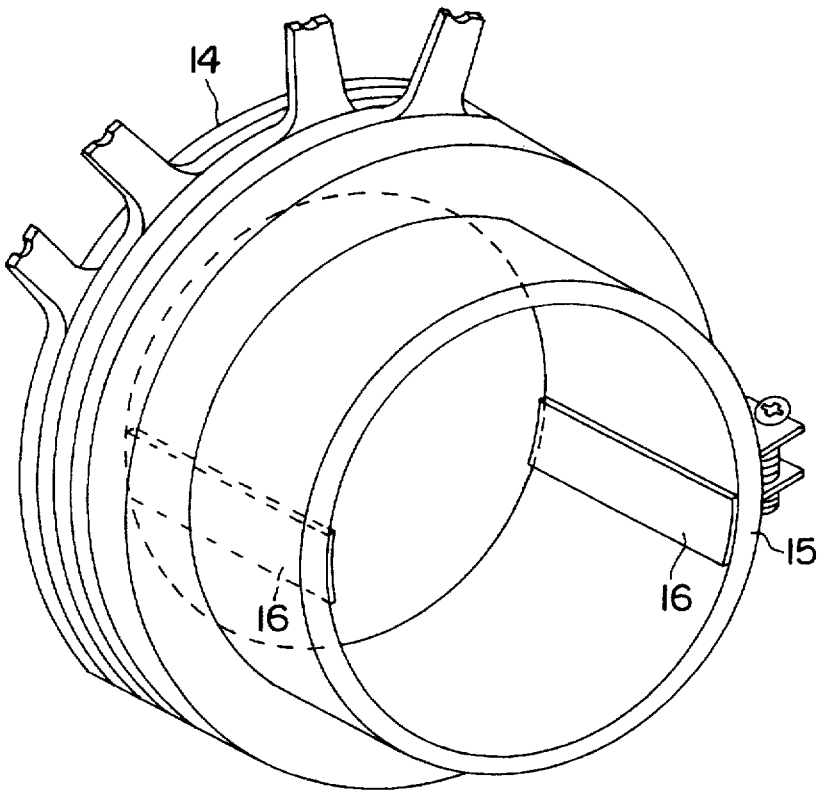
FIG. 4 is a perspective view illustrating a convergence magnet and a holder thereof in Example 2 according to the present invention.

FIG. 4 is a perspective view illustrating a convergence magnet 14 and a holder 15 thereof attached to a color CRT. The color CRT of Example 2 has the convergence magnet 14 at the joint portion (the rear portion of the deflection yoke) of the neck tube 11 shown in FIG. 3. The convergence magnet 14 is attached so as to surround the neck tube 11 by means of the holder 15, thereby slightly changing the traces of the three electron beams emitted from the electron gun 12. Thus, the three electron beams are concentrated on the middle section of the phosphor screen 6 and the color purity of image is corrected.

In Example 2, the holder 15 of the convergence magnet 14 is used as a fixing means of the magnetic members 16. Namely, a pair of the magnetic members 16 are disposed on the inner surface of the holder 15 of the convergence magnet 14 so that at least parts thereof face each other. Thereafter, when the convergence magnet 14 attached to the holder 15 is mounted onto the predetermined position of the above-mentioned neck tube 11, the pair of the magnetic members 16 are placed in the horizontal direction of the screen. As a result, misconvergence of the electron beams can be prevented similarly as described in Example 1.

Generally, when the convergence magnet 14 is fixed to the neck tube 11, at first a glass tape or the like is wound around a portion of the neck tube 11 to which the holder 15 is to be attached for preventing the damage to the neck tube 11 and the slip. Then, the holder 15 is attached thereon. Since the glass tape can be treated as integral with the outer surface of the neck tube 11, it is apparent that the grass tape does not affect the advantages obtained by the magnet members 13 in Example 2. Thus, although it is not explained in FIG. 4 for simplicity, the similar glass tape is used for attaching the holder 15 of the convergence magnet 14 to the outer surface of the neck tube 11 in Example 2.

In the above description of Example 2, the magnetic members 16 have the same length as the holder 15 in the axis direction. Alternatively, the length of the magnetic members 16 is not necessarily the same as the holder 15 in the axis direction. Moreover, the features of the magnetic members 13 such as the shape, the processing method, and attaching method as described in Example 1 are similarly observed in the magnetic members 16 of Example 2.

EXAMPLE 3

Example 3 of the present invention will be described with reference to FIG. 5.

Figure 5:
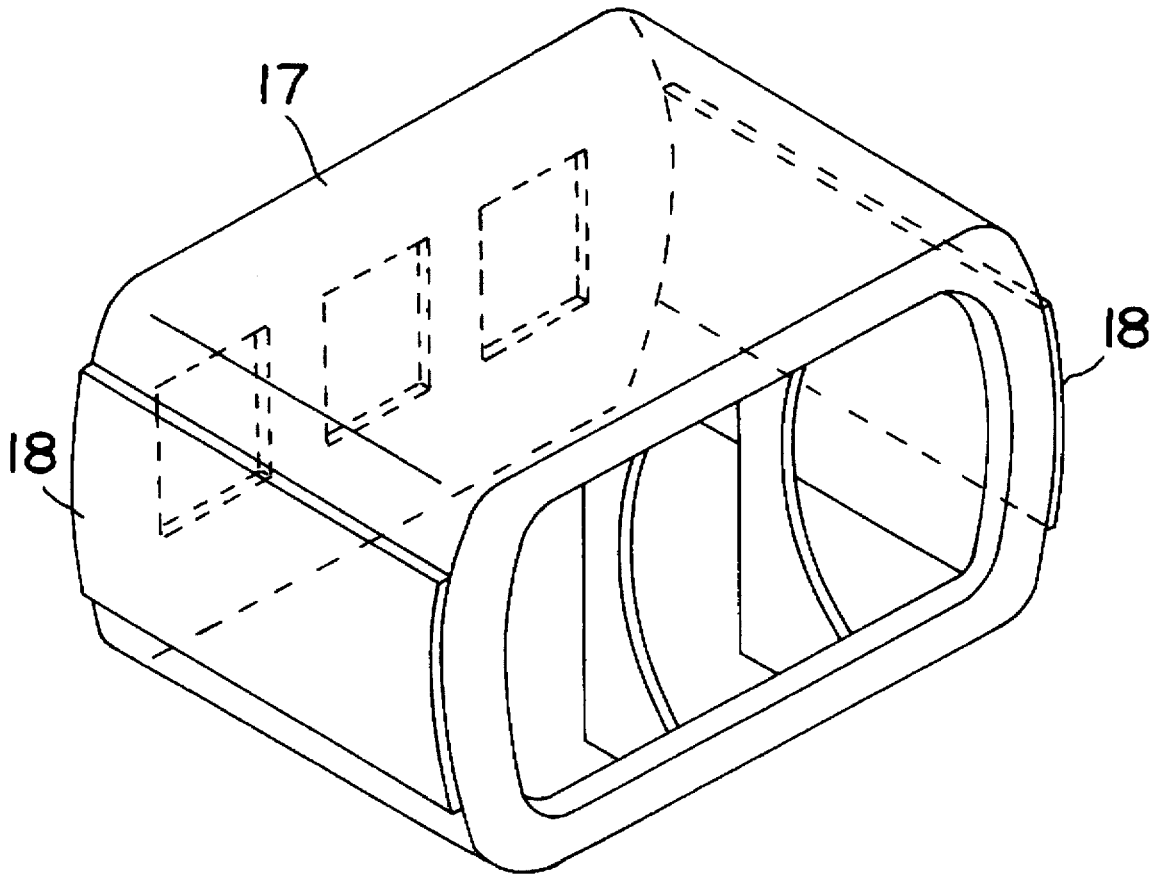
FIG. 5 is a perspective view illustrating an electron gun in Example 3 according to the present invention.

FIG. 5 is a perspective view illustrating a portion of a grid electrode 17 which is one of a plurality of grid electrodes (G1–G4 in FIG. 1) constituting an electron gun 12 of a color CRT of Example 3. In Example 3, a pair of magnetic members 18 are attached to the side wall of the grid electrode 17 i.e., the side wall of the electron gun 12) so that at least parts thereof face each other. Thus, misconvergence of the electron beams, similarly prevented as described in Examples 1 and 2, can be obtained.

In FIG. 5, the magnetic members 18 are attached to only one grid electrode 17. Alternatively, the magnetic members 18 can be attached to two or more grid electrodes depending on the degree of the misconvergence. Moreover, the magnetic members 18 may be attached to the inner side wall of the grid electrode 17, although the magnetic members 18 of FIG. 5 are attached to the outer side wall of the grid electrode 17. Alternatively, the side wall of the grid electrode 17 may be composed of the magnetic members 18. Furthermore, the features of the magnetic members 13 such as the shape, the processing method, attaching method and the like described in Example 1 are observed in the magnetic members 18 of Example 3.

Next, an example of the result of the experiments conducted for confirming the advantage of preventing misconvergence by means of the magnetic members of the present invention will be shown.

In the following experiment, a color CRT for a 17-inch computer display (the size of the screen is 302 mm×224 mm) including the neck tube having an outer diameter of 29.5 mm was used. An average current of the three electron beams emitted from the electron gun was 3 μA. A voltage of 25 kV was applied to an anode. A deflection yoke for 64 kHz was used; the horizontal deflection frequency was set to be 64 kHz, and the vertical deflection frequency was set to be 60 Hz.

In the color CRT having the above configuration, the result between the conventional color CRT having no magnetic members and the color CRT having the magnetic members according to the present invention was compared. The magnetic members were attached to the inner surface of the holder of the convergence magnet, as described in Example 2. An Fe50%—Ni50% alloy processed to have a plate-shape with dimensions of 7 mm (wide), 40 mm (long) and 0.05 mm (thick) was used as the magnetic members. The magnetic members were curved to be attached to the holder so as to be positioned along the curved-shape of the inner surface of the holder.

Under the conditions as described above, the magnetic field of 0.04 mT was applied in the perpendicular direction to the electron beams while the magnetic field in the axis direction of the electron gun was increased from 0 mT to 0.035 mT, whereby the amount of change in convergence in the middle section of the screen was measured by using a cross-hatch pattern.

The cross-hatch pattern, which is a lattice-like pattern, is one of the standard patterns for performance measurement of CRTs. When the convergence is precisely obtained, three fine lines of red, green and blue are overlapped with each other on the screen to form a single white line. However, when misconvergence occurs, the fine lines are deviated upward and downward from each other. The amount of the deviation between the fine lines due to the change in the magnetic field webs measured as the amount of change in convergence.

A result shows that, in the conventional color CRT having no magnetic members, the amount of change in convergence was 0.29 mm when the magnetic field of 0.035 mT applied in the axis direction of the electron gun; whereas in the color CRT of the present invention having the magnetic members, the amount of change in convergence was 0.04 mm under the same condition. Accordingly, it is confirmed that the significant advantage of preventing misconvergence can be obtained by using the magnetic members in accordance with the present invention.

In consideration of cost and efficiency in processing and attaching, it is preferable that the magnetic members are thin. The similar measurements were carried out by changing the thickness of the magnetic members within the range of 0.05 mm to 1 mm, and no distinguishing interrelation between the thickness of the magnetic members and the amount of change in convergence was observed. The misconvergence was similarly prevented within the above range of the thickness of the magnetic members.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A color cathode ray tube comprising:

an in-line type electron gun for generating three electron beams; and a bulb having a neck tube enclosing the in-line type electron gun, wherein the color cathode ray tube further comprises magnetic means for mitigating effects of an external magnetic field along an axis direction of the in-line type electron gun on convergence of the electron beams, the magnetic means including a pair of magnetic members being disposed in a horizontal plane including the three electron beams so as to sandwich the three electron beams, each of the pair of magnetic members being formed of a high permeability magnetic material having a specific magnetic permeability which is greater than 1 and is high enough for the external magnetic field to pass through the inside of the magnetic members, thereby preventing misconvergence of the electron beams.

2. A color cathode ray tube according to claim 1, wherein the magnetic means is respectively located between two outermost electron beams among the three electron beams and an outer surface of the neck tube.

3. A color cathode ray tube according to claim 1, wherein the magnetic means is provided on the outer surface of the neck tube.

4. A color cathode ray tube according to claim 1, further comprising:

a convergence magnet; and a holder attached to the outer surface of the neck tube for supporting the convergence magnet, wherein the magnetic means is provided on an inner surface of the holder.

5. A color cathode ray robe according to claim 1, wherein a side wall of the in-line type electron gun includes the magnetic means.

6. A color cathode ray tube according to claim 1, wherein the pair of magnetic members are disposed so that at least parts thereof face each other sandwiching the three electron beams in the horizontal plane including the three electron beams.

7. A color cathode ray tube according to claim 1, wherein the magnetic means is formed of magnetic alloy of iron and nickel.

8. A color cathode ray tube according to claim 1, wherein the magnetic means is processed to have a plate-shape.

9. A color cathode ray tube according to claim 6, wherein one of the pair of the magnetic members is located between a left outermost electron beam among the three electron beams and a left outer surface of the neck tube, and the other of the pair of the magnetic members is located between a right outermost electron beam among the three electron beams and a right outer surface of the neck tube.

10. A color cathode ray tube according to claim 6, wherein one of the pair of the magnetic members is provided on the left outer surface of the neck tube, and the other of the pair of the magnetic members is provided on the right outer surface of the neck tube.

11. A color cathode ray tube according to claim 6, wherein each of the pair of the magnetic members is further divided into a plurality of portions.

12. A color cathode ray tube according to claim 6, further comprising:

a convergence magnet; and a holder attached to the outer surface of the neck tube for holding the convergence magnet, wherein the magnetic members are provided on the inner surface of the holder.

13. A color cathode ray tube according to claim 6, wherein the magnetic members are provided on the side wall of the in-line type electron gun.

14. A color cathode ray tube according to claim 8, wherein the thickness of the magnetic means is within a range of 0.05 mm to 0.1 mm.

* * * * *

UNITED STATES PATENT AND TRADEMARK OFFICE

CERTIFICATE OF CORRECTION

PATENT NO. : 5,530,315
DATED : June 25, 1996
INVENTOR(S) : Arimoto et al

It is certified that error appears in the above-indentified patent and that said Letters Patent is hereby corrected as shown below:

On the title page, item [54] and column 1, line 5, change "ELECTION" to — ELECTRON —.

Item [56] References Cited, under U.S. Patent Documents: Change "2,905,846" to --2,905,847--.

Column 8, line 6, insert --(-- between "17" and "i.e.,".

Column 8, line 64, "webs" should be --was--.

Column 10, line 6, change "robe" to --tube--.

Signed and Sealed this
Tenth Day of December, 1996

*Attest:*

*Attesting Officer*

BRUCE LEHMAN

*Commissioner of Patents and Trademarks*